United States Patent [19]

Eiermann et al.

[11] 4,127,364

[45] Nov. 28, 1978

[54] HEAT PUMP UNIT

[75] Inventors: Dankwart Eiermann; Otto Kraic, both of Lindau, Germany

[73] Assignee: Wankel GmbH, Germany

[21] Appl. No.: 823,135

[22] Filed: Aug. 9, 1977

[30] Foreign Application Priority Data

Aug. 10, 1976 [DE] Fed. Rep. of Germany ..... 2635971

[51] Int. Cl.[2] ..... F04B 35/00; F04B 39/00; F04C 29/04; F04C 17/06

[52] U.S. Cl. ..... 417/373; 417/406; 418/152; 418/171; 418/210

[58] Field of Search ..... 417/373, 405, 406; 418/166, 167, 171, 210; 62/402

[56] References Cited

U.S. PATENT DOCUMENTS

| | | | |
|---|---|---|---|
| 892,295 | 6/1908 | Nutz | 418/171 X |
| 3,126,755 | 3/1964 | Luck | 418/171 X |
| 3,306,531 | 2/1967 | Oppermann | 418/166 |
| 3,330,213 | 7/1967 | Donaldson | 417/373 X |
| 3,823,695 | 7/1974 | Swartz | 418/171 X |
| 3,956,904 | 5/1976 | Edwards | 418/210 X |

*Primary Examiner*—Carlton R. Croyle
*Assistant Examiner*—Leonard E. Smith
*Attorney, Agent, or Firm*—Walter Becker

[57] ABSTRACT

A heat pump unit comprising a compressor and an expansion machine for respectively compressing and re-expanding a medium which circulates in a heating or cooling circuit. The power used for compressing this medium is at least partly recovered in the expansion machine and is used for driving the compressor. The compressor and the expansion machine are inner axle, intermeshing rotary piston engines which are arranged directly adjacent to one another on a common shaft. The inner side walls of the rotary engines are adjacent to each other and have cavities and thermal insulating means interposed between them and, while being interconnected, are fixedly connected on the one hand to the shaft and on the other hand with outer rotors. The shaft is rotatably journalled in eccentrics of inner rotors, which eccentrics are rigidly connected with a stationary housing.

4 Claims, 3 Drawing Figures

HEAT PUMP UNIT

The present invention relates to a heat pump unit comprising a compressor and an expansion machine for respectively compressing and re-expanding a medium which circulates in a heating or cooling circuit. The power used for compressing this medium is at least partly recovered in the expansion machine and is employed for driving the compressor.

Such circulating systems, referred to as heat pumps, have previously been proposed not only as closed system, according to which the medium is, for example, halogenated hydrocarbons, but also as open systems, which operate with atmospheric air.

In addition to using reciprocating piston engines for such heat pumps, it is also possible to use rotary engines in the form of turbo-compressors, which however are unbearably noisy. Vane cell engines (circular piston-like rotary piston engines), which are otherwise conventional for such purposes, give rise to substantial mechanical difficulties, particularly since when used for conveying air they must operate without any lubrication at all, so that their parts run dry. Furthermore, their speed of rotation is very limited.

It is therefore an object of the present invention to provide a very compactly constructed compression-expansion machine unit which can operate without lubrication at a high speed of rotation.

This object and other objects and advantages of the present invention will appear more clearly from the following specification in connection with the accompanying drawings, in which.

The heat pump unit pursuant to the present invention is characterized primarily in that the compressor and the expansion machine are inner axle, intermeshing rotary piston engines which are arranged directly adjacent to one another on a common shaft. The inner side walls of the rotary engines are adjacent to each other and have cavities and thermal insulating means interposed between them and, while being interconnected, are fixedly connected on the one hand to the shaft and on the other hand with outer rotors. The shaft is rotatably journalled in eccentrics of inner rotors, which eccentrics are rigidly connected with a stationary housing.

Figure 1:
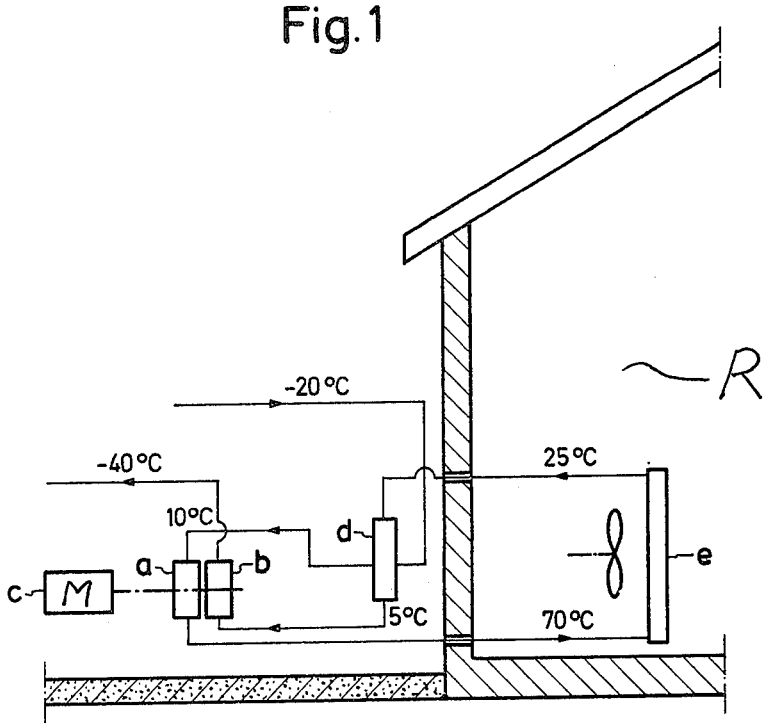
FIG. 1 shows an overall arrangement of an open heat pump system.

Referring now to the drawings in detail, an example of an open heat pump system is shown in FIG. 1. A compressor *a* and an expansion machine *b* are connected with the same shaft, which is driven by the motor *c*. The working air taken from the atmosphere is drawn in through the heat exchanger *d* by the compressor *a*. The air, which is compressed and heated up to, for example, 70° C. by the compressor, gives up its heat content in the room heating element or radiator *e* to the room R, except for residual heat corresponding to the temperature of the room. This residual heat content is transferred in the above mentioned heat exchanger *d* to the air which is drawn in from the atmosphere by the compressor. In the expansion machine *b*, the pressure of the cold air released by the heat exchanger *d* is subsequently converted into mechanical energy, which is transferred to the compressor by means of the common shaft. The expansion machine *b* returns the air, which has expanded in the former and has now been considerably cooled, to the atmosphere. In FIG. 1, examples for the temperatures of the individual sections of the system are indicated.

Figure 3:
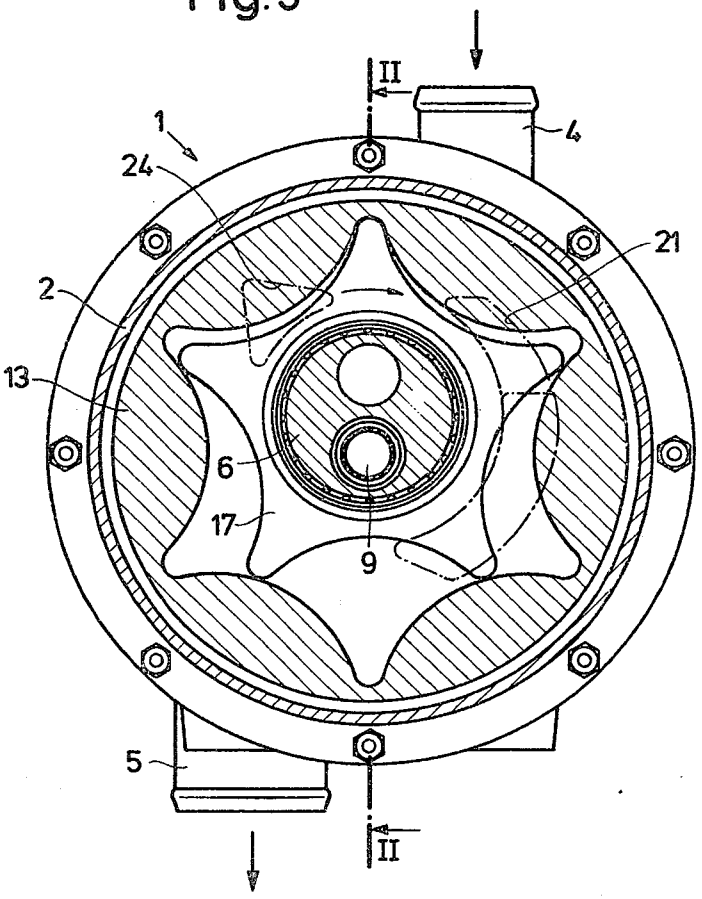
FIG. 3 is a radial section through the unit of FIG. 2 taken along the line III—III of FIG. 2.
Figure 2:
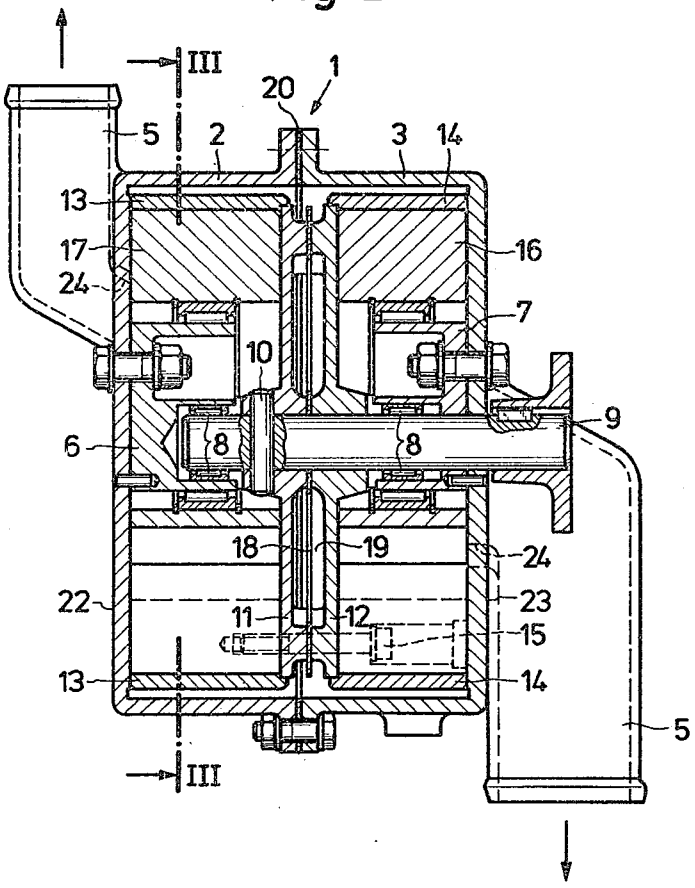
FIG. 2 shows an axial section through the heat pump unit of the present invention taken along the line II—II of FIG. 3.

The heat pump in FIGS. 2 and 3 is encased in a stationary housing 1 which is common to a compressor and an expansion machine and which comprises two bolted together shells 2 and 3. The housing 1 has two inlet pipe connectors 4 and two outlet pipe connectors 5. The eccentric 6 for the compressor and the eccentric 7 for the expansion machine are fixedly connected to the housing 1. The common shaft 9 rotates on antifriction bearings 8 in the stationary eccentrics 6 and 7. The inner side walls 11 and 12 of the two machines are keyed on the shaft 9 by means of pins 10. The two outer rotors 13 and 14 are fixedly connected with the two machines. The outer rotors 13 and 14 are bolted together at 15. The outer rotors 13 and 14 accordingly rotate with the shaft 9 and drive the inner rotors 16 and 17, which are rotatably arranged on the eccentrics 6 and 7 in a gear-like manner without requiring a special synchronizing drive. The inner side walls 11 and 12 are sealed from one another, to prevent the passage of heat, by means of a thermal insulating plate 18 arranged between them, and by means of a cavity 19, which in turn is radially divided by the plate 18. In a similar manner, the two housing shells 2 and 3 are sealed from one another by means of a sealing ring 20 which is placed between them. The sealing material of the plate 18 and of the sealing 20 may be asbestos or a strong organic synthetic material.

Since the temperatures obtained with the compressor are already restricted with regard to the intended purpose of use, either the internal rotors 16 and 17 or the outer rotors 13 and 14, or both the inner and the outer rotors, can be made of slidable or self-lubricating material such as polytetrafluoroethylene with embedded bronze particles, so that lubrication of the intermeshing surfaces of the inner and outer rotors is not necessary. The inlets 21 of the two machines, which inlets open to several working chambers, are arranged in the conventional manner in the outer stationary side walls 22 and 23 and are directly connected with the inlet pipe connectors 4 which are arranged on these side walls. In a similar manner, the outlets 24 are provided in the same side walls 22 and 23 and open directly into the pipe connectors 5 arranged on the latter.

It is, of course, to be understood that the present invention is by no means limited to the specific showing in the drawings, but also encompasses any modifications within the scope of the appended claims.

What we claim is:

1. A heat pump unit, for circulating a medium through a temperature controlling circuit, which comprises:

a stationary housing;

compressor means arranged within said housing for compressing said medium;

expansion means arranged within said housing for reexpanding said medium, said compressor means and said expansion means both being inner axle, intermeshing rotary piston engines which are arranged directly adjacent to one another and which each comprise inner side walls which are adjacent to one another and are interconnected and confine cavities therebetween;

thermal insulating means interposed between said inner side walls;

a shaft connected with both said compressor means and said expansion means, said shaft being fixedly connected to said inner side walls;

outer rotary means fixedly connected to said inner side walls;

eccentrics rigidly connected with said housing, said shaft being rotatably journalled in said eccentrics;

inner rotary means rotatably journalled about said eccentrics;

inlet means associated with said heat pump unit for supplying said medium to same; and outlet means associated with said heat pump unit for discharging said medium from same.

2. A heat pump unit according to claim 1, which includes means for recovering energy in said expansion means for driving said compressor means.

3. A heat pump unit according to claim 1, in which at least one of said inner and outer rotor means comprises an outer surface of friction-reducing material.

4. A heat pump unit according to claim 1, in which said stationary housing comprises two interconnected sections in which said compression and expansion means are respectively arranged, said sections forming the outer side walls of said compression and expansion means and being insulated from one another against heat transfer.

* * * * *